US011193705B2

(12) United States Patent
Hatanaka

(10) Patent No.: US 11,193,705 B2
(45) Date of Patent: Dec. 7, 2021

(54) REFRIGERATION CYCLE APPARATUS

(71) Applicant: Mitsubishi Electric Corporation, Tokyo (JP)

(72) Inventor: Kensaku Hatanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 73 days.

(21) Appl. No.: 16/757,650

(22) PCT Filed: Nov. 2, 2017

(86) PCT No.: PCT/JP2017/039682
§ 371 (c)(1),
(2) Date: Apr. 20, 2020

(87) PCT Pub. No.: WO2019/087346
PCT Pub. Date: May 9, 2019

(65) Prior Publication Data

US 2020/0326112 A1 Oct. 15, 2020

(51) Int. Cl.

| | |
|---|---|
| ***F25B 49/02*** | (2006.01) |
| ***F25B 13/00*** | (2006.01) |
| ***F25B 39/00*** | (2006.01) |
| ***F25B 41/22*** | (2021.01) |
| ***F25B 41/31*** | (2021.01) |

(52) U.S. Cl.
CPC ..... *F25B 49/02* (2013.01); *F25B 13/00* (2013.01); *F25B 39/00* (2013.01); *F25B 41/22* (2021.01); *F25B 41/31* (2021.01); *F25B 2500/26* (2013.01); *F25B 2500/27* (2013.01); *F25B 2600/2513* (2013.01); *F25B 2600/2515* (2013.01); *F25B 2700/19* (2013.01); *F25B 2700/21* (2013.01)

(58) Field of Classification Search
CPC ..... F25B 13/00; F25B 39/00; F25B 49/02; F25B 49/022
See application file for complete search history.

(56) References Cited

U.S. PATENT DOCUMENTS

2017/0038125 A1* 2/2017 Tani ..... F25B 47/022

FOREIGN PATENT DOCUMENTS

JP 2012-167860 A 9/2012

* cited by examiner

*Primary Examiner* — Henry T Crenshaw
(74) *Attorney, Agent, or Firm* — Posz Law Group, PLC

(57) ABSTRACT

A first valve is connected between a compressor and a first heat exchanger. A second valve is connected between the first heat exchanger and a expansion valve. When a start condition of the heating operation is satisfied and when a specific condition is satisfied, a controller starts supplying refrigerant from the compressor to the first valve, and then, opens the first and second valves. The specific condition is a condition indicating that a first heat exchange capability of the first heat exchanger is higher than a second heat exchange capability of a second heat exchanger. When the start condition of the heating operation is satisfied and when the specific condition is not satisfied, the controller opens the first and second valves, and then starts supplying the refrigerant from the compressor to the first valve.

5 Claims, 17 Drawing Sheets

REFRIGERATION CYCLE APPARATUS

CROSS REFERENCE TO RELATED APPLICATION

This application is a U.S. national stage application of PCT/JP2017/039682 filed on Nov. 2, 2017, the contents of which are incorporated herein by reference.

TECHNICAL FIELD

The present invention relates to a refrigeration cycle apparatus that performs a heating operation.

BACKGROUND ART

A conventionally known refrigeration cycle apparatus traps refrigerant in a condenser when stopping a heating operation, thereby improving user's comfort in start of the heating operation. For example, Japanese Patent Laying-Open No. 2012-167860 (PTL 1) discloses a heat-pump-type air conditioner in which an indoor heat exchanger is connected between two on-off valves, and the two on-off valves are closed in start of a defrosting operation to trap refrigerant in the indoor heat exchanger. The heat-pump-type air conditioner has improved heating capability when ending the defrosting operation and starting the heating operation. This leads to improved user's comfort in the heating operation.

CITATION LIST

Patent Literature

PTL 1: Japanese Patent Laying-Open No. 2012-167860

SUMMARY OF INVENTION

Technical Problem

When the heating operation is stopped, the refrigerant trapped in the first heat exchanger which has functioned as a condenser in the heating operation is cooled as time elapses from the stop of the heating operation. Since a temperature difference between the air around the first heat exchanger and the refrigerant decreases, the heat exchange capability (a heat exchange amount per unit time between refrigerant and air) of the first heat exchanger decreases. The relationship of magnitude between the first heat exchange capability of the first heat exchanger and the second heat exchange capability of the second heat exchanger which has functioned as an evaporator in the heating operation changes depending on an elapsed time from the stop of the heating operation. In order to improve heating capability in star of the heating operation, the refrigeration cycle apparatus needs to be controlled such that refrigerant is distributed in favor of a heat exchanger with high heat exchange capability in consideration of this relationship of magnitude. According to Japanese Patent Laying-Open No. 2012-167860 (PTL 1), however, variations in the relationship of magnitude of heat exchange capability associated with an elapsed time from a stop of the heating operation is not taken into consideration.

The present invention has been made to solve the above problem, and an object thereof is to improve heating capability in start of a heating operation.

Solution to Problem

In a refrigeration cycle apparatus according to the present invention, refrigerant circulates in order of a compressor, a first heat exchanger, an expansion valve, and a second heat exchanger in a heating operation. The refrigeration cycle apparatus includes a first valve, a second valve, and a controller. The first valve is connected between the compressor and the first heat exchanger. The second valve is connected between the first heat exchanger and the expansion valve. When a stop condition of the heating operation is satisfied, the controller closes the first and second valves. When a start condition of the heating operation is satisfied and when a specific condition is satisfied, the controller starts supplying the refrigerant from the compressor to the first valve and then opens the first and second valves. The specific condition is a condition indicating that a first heat exchange capability of the first heat exchanger is higher than a second heat exchange capability of the second heat exchanger. When the start condition of the heating operation is satisfied and when the specific condition is not satisfied, the controller opens the first and second valves and then starts supplying the refrigerant from the compressor to the first valve.

Advantageous Effects of Invention

The refrigeration cycle apparatus according to the present invention reverses the order of the process of opening the first and second valves and the process of starting supply of refrigerant from the compressor to the first valve in accordance with whether the specific condition, indicating that the first heat exchange capability is higher than the second heat exchange capability, is satisfied when the start condition of the heating operation is satisfied, leading to improved heating capability in start of the heating operation.

DESCRIPTION OF EMBODIMENTS

Figure 1:
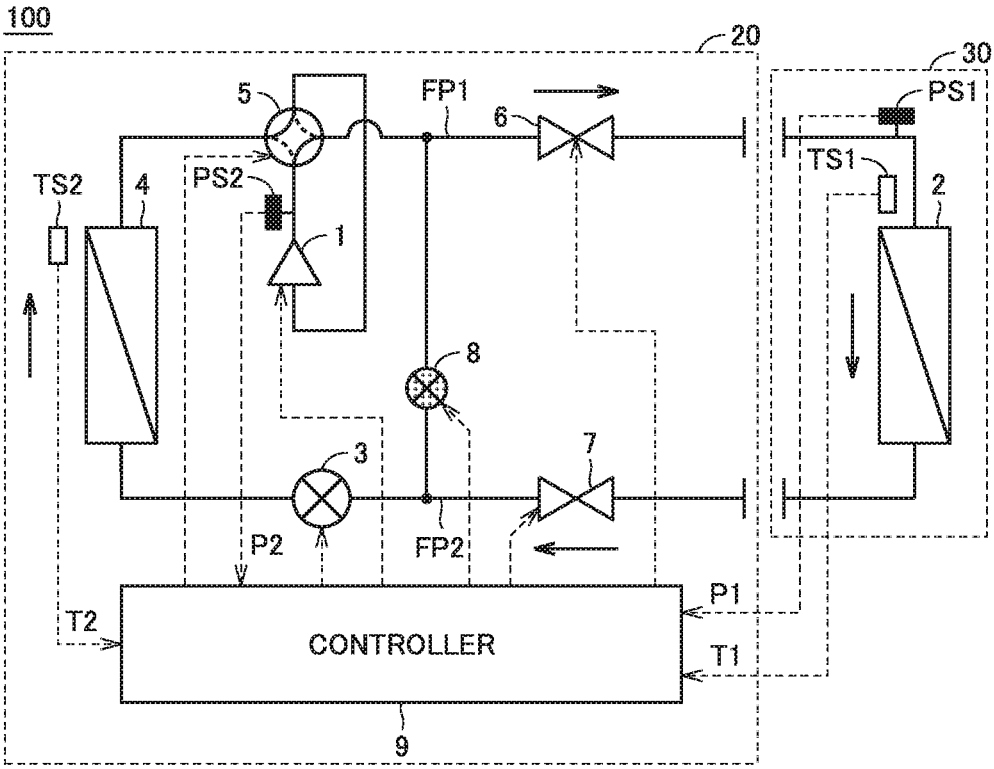
FIG. 1 is a functional block diagram showing a configuration of a refrigeration cycle apparatus according to Embodiment 1 and a flow of refrigerant in a heating operation.

Embodiments of the present invention will now be described in detail with reference to the drawings. The same or corresponding parts are designated by the same references in the drawings, description of which will not be repeated in principle.

Embodiment 1

FIG. 1 is a functional block diagram showing a configuration of a refrigeration cycle apparatus 100 according to Embodiment 1 and a flow of refrigerant in a heating operation. As shown in FIG. 1, refrigeration cycle apparatus 100 includes an outdoor unit 20 and an indoor unit 30. Outdoor unit 20 includes a compressor 1, an expansion valve 3, a second heat exchanger 4, a four-way valve 5 (flow path switching valve), a first solenoid valve 6 (first valve), a second solenoid valve 7 (second valve), a bypass valve 8 (third valve), and a controller 9. Indoor unit 30 includes a first heat exchanger 2.

Compressor 1 sucks gas refrigerant from second heat exchanger 4, adiabatically compresses the refrigerant, and discharges high-pressure gas refrigerant to first heat exchanger 2. First heat exchanger 2 is placed indoors and functions as a condenser in the heating operation. The gas refrigerant from compressor 1 releases condensation heat and is condensed in first heat exchanger 2 to turn into liquid refrigerant. Expansion valve 3 adiabatically expands the liquid refrigerant from first heat exchanger 2 and decompresses the liquid refrigerant, and causes refrigerant in a gas-liquid two-phase state (wet steam) to flow out to second heat exchanger 4. Expansion valve 3 includes, for example, a linear expansion valve (LEV). Second heat exchanger 4 is placed outdoors and functions as an evaporator in the heating operation. Wet steam from expansion valve 3 absorbs evaporation heat from the outside air and evaporates in second heat exchanger 4.

First solenoid valve 6 is connected between compressor 1 and first heat exchanger 2. Second solenoid valve 7 is connected between first heat exchanger 2 and expansion valve 3. Bypass valve 8 is connected between a first flow path FP1 between four-way valve 5 and first solenoid valve 6 and a second flow path FP2 between second solenoid valve 7 and expansion valve 3.

Four-way valve 5 connects a discharge port of compressor 1 and first solenoid valve 6 to each other and also connects an inlet port of compressor 1 and second heat exchanger 4 to each other in the heating operation. Four-way valve 5 forms a flow path in the heating operation such that refrigerant circulates in order of compressor 1, four-way valve 5, first solenoid valve 6, first heat exchanger 2, second solenoid valve 7, expansion valve 3, second heat exchanger 4, and four-way valve 5.

Controller 9 switches the operation mode of refrigeration cycle apparatus 100 to cause refrigeration cycle apparatus 100 to perform the heating operation, cooling operation, or defrosting operation. Controller 9 controls the drive frequency of compressor 1 to control an amount (volume) of refrigerant discharged by compressor 1 per unit time. Controller 9 controls four-way valve 5 to switch the direction of circulation of refrigerant. Controller 9 controls the degree of opening of expansion valve 3 to adjust the temperatures, the flow rate, and pressure of refrigerant of first heat exchanger 2 and second heat exchanger 4. Controller 9 controls opening/closing of first solenoid valve 6, second solenoid valve 7, and bypass valve 8. In the heating operation, controller 9 keeps first solenoid valve 6 and second solenoid valve 7 open and keeps bypass valve 8 closed.

Controller 9 obtains a first pressure P1 of refrigerant between first solenoid valve 6 and first heat exchanger 2 from a pressure sensor PS1. Pressure sensor PS1 is disposed in indoor unit 30. Controller 9 obtains a second pressure P2 of refrigerant between compressor 1 and first solenoid valve 6 from a pressure sensor PS2. Pressure sensor PS2 is disposed in a pipe connected to the discharge port of compressor 1.

Controller 9 obtains a first temperature T1 as an indoor temperature from a temperature sensor TS1. Temperature sensor TS1 is disposed near a port of first heat exchanger 2 into which refrigerant flows in the heating operation. Temperature sensor TS1 may be disposed in any place as long as it can measure indoor temperature. Controller 9 obtains a second temperature T2 as an outdoor temperature from a temperature sensor TS2. Temperature sensor TS2 is disposed near a port of second heat exchanger 4 from which refrigerant flows out in the heating operation. Temperature sensor TS2 may be disposed in any place as long as it can measure outdoor temperature.

Figure 2:
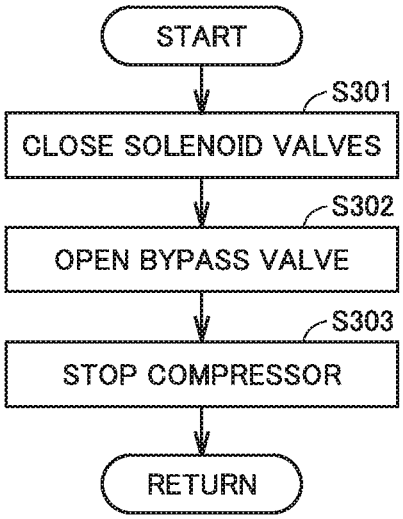
FIG. 2 is a flowchart showing a process performed by a controller of FIG. 1 when a user has provided a stop instruction.

FIG. 2 is a flowchart showing a process performed by controller 9 when a user has instructed to stop the heating operation. The process shown in FIG. 2 is performed through a main routine (not shown). The same applies to FIGS. 6 to 9, 11, and 18 to 21. A step will be merely referred to as S below. A condition that the user has provided a stop instruction is included in a stop condition of the heating operation. The instruction to stop the heating operation by the user includes an instruction to specify a stop time.

As shown in FIG. 2, controller 9 closes first solenoid valve 6 and second solenoid valve 7 at S301 and advances the process to S302. Controller 9 opens bypass valve 8 at S302 and advances the process to S303. Controller 9 stops compressor 1 at S303 and returns the process to the main routine.

Figure 3:
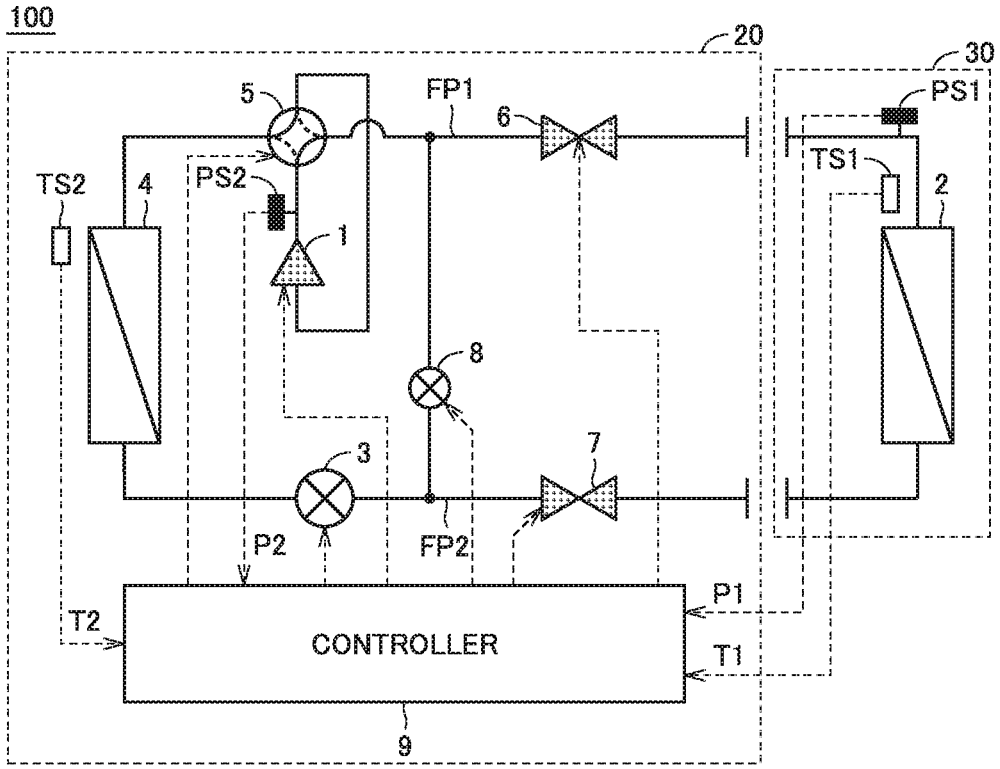
FIG. 3 is a functional block diagram showing a configuration of the refrigeration cycle apparatus when the heating operation is stopped.

FIG. 3 is a functional block diagram showing a configuration of refrigeration cycle apparatus 100 when the heating operation is stopped. As shown in FIG. 3, a pressure difference between refrigerant discharged from compressor 1 and refrigerant sucked by compressor 1 decreases by a pressure equalization action of bypass valve 8 which is opened when the heating operation is stopped. Also, first solenoid valve 6 and second solenoid valve 7 are closed when the heating operation is stopped, and accordingly, refrigerant is trapped in first heat exchanger 2. The refrigerant is cooled as time elapses from the stop of the heating operation. Since the temperature difference between the air around first heat exchanger 2 and the refrigerant decreases, the heat exchange capability of first heat exchanger 2 decreases.

Figure 4:
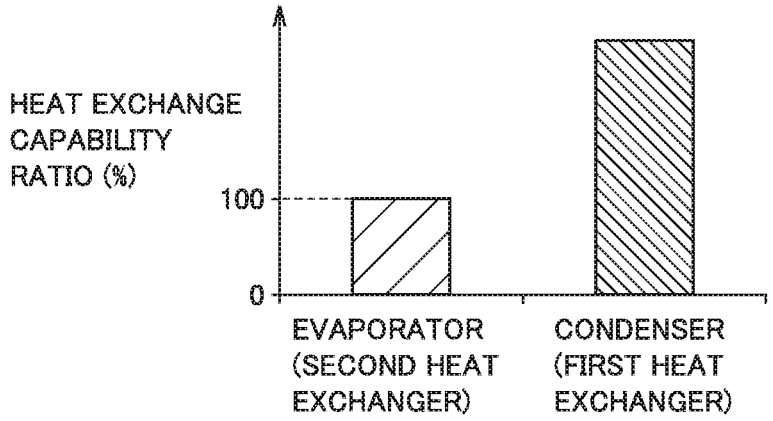
FIG. 4 shows a ratio between a first heat exchange capability of a first heat exchanger and a second heat exchange capability of a second heat exchanger when the heating operation is started at a first temperature higher than a second temperature.
Figure 5:
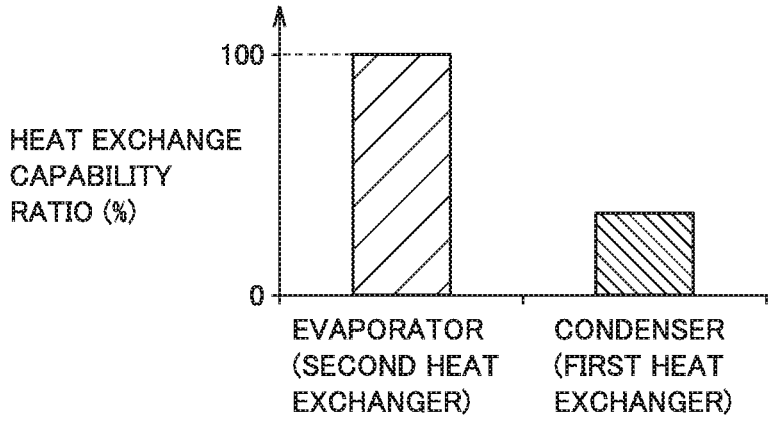
FIG. 5 shows a ratio between the first heat exchange capability and the second heat exchange capability when the heating operation is started at the first temperature lower than the second temperature after a lapse of time from a stop of the heating operation.

FIG. 4 shows a ratio between the first heat exchange capability of first heat exchanger 2 and the second heat exchange capability of second heat exchanger 4 when the heating operation is started at first temperature T1 higher than second temperature T2. FIG. 5 shows a ratio between the first heat exchange capability and the second heat exchange capability when the heating operation is started at first temperature T1 lower than second temperature T2 after a lapse of time from the stop of the heating operation. FIGS. 4 and 5 each show the magnitude of the first heat exchange capability when the reference value of the second heat exchange capability is 100%.

As shown in FIG. 4, when the first heat exchange capability is higher than the second heat exchange capability, the heating capability of refrigeration cycle apparatus 100 is improved more by starting the heating operation such that a larger amount of refrigerant is distributed through the first heat exchanger than through the second heat exchanger. In contrast, as shown in FIG. 5, when the second heat exchange capability is higher than the first heat exchange capability, heating capability is improved more by starting the heating operation such that a larger amount of refrigerant is distributed through the second heat exchanger than through the first heat exchanger.

Refrigeration cycle apparatus 100, thus, when the start condition of the heating operation is satisfied, reverses the order of the process of opening first solenoid valve 6 and second solenoid valve 7 and the process of starting supply of refrigerant from compressor 1 to first solenoid valve 6 in accordance with whether a specific condition indicating that the first heat exchange capability is higher than the second heat exchange capability is satisfied, leading to improved heating capability in start of the heating operation.

Figure 6:
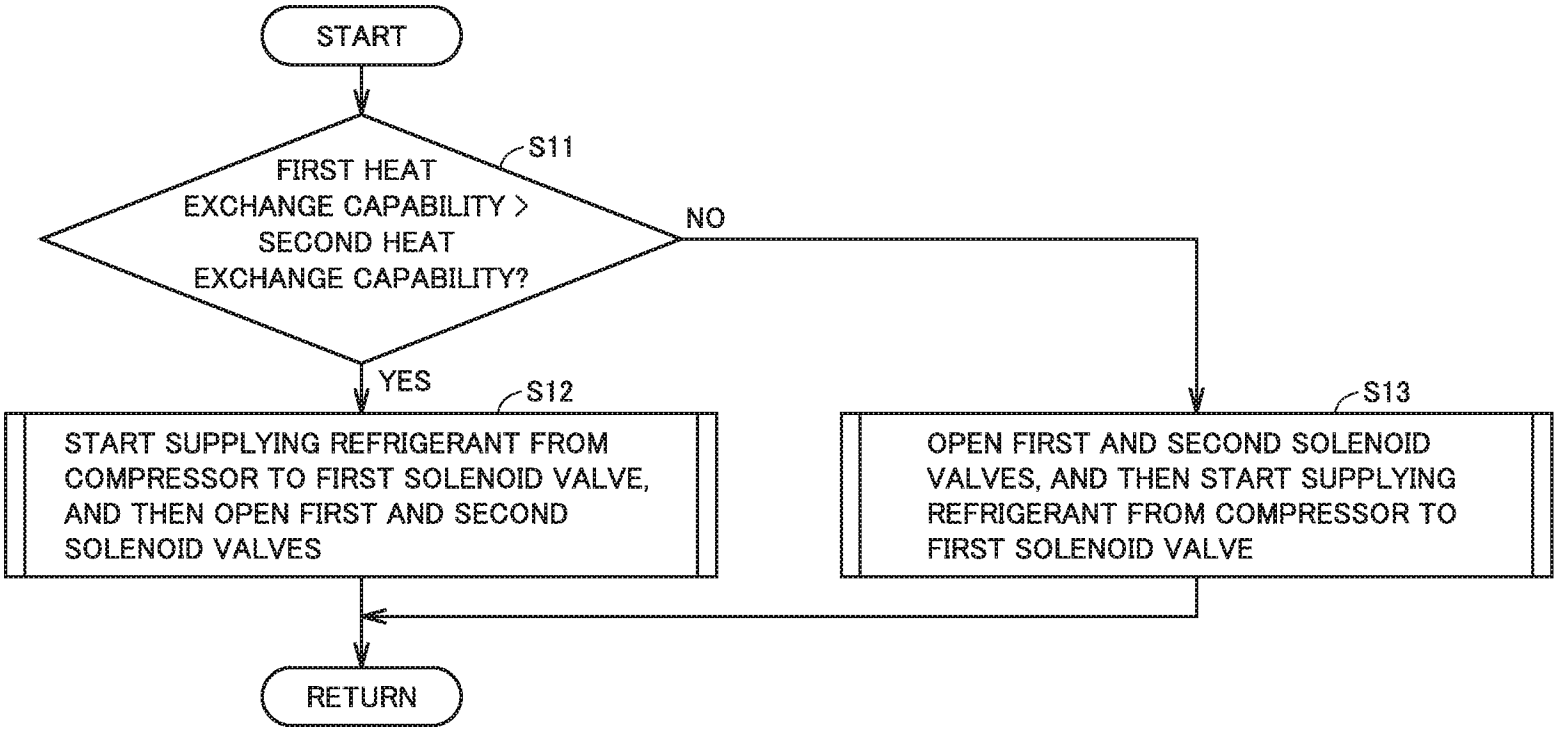
FIG. 6 is a flowchart showing a process of starting the heating operation performed by the controller of FIG. 1.

FIG. 6 is a flowchart showing the process of starting the heating operation performed by controller 9 of FIG. 1 when the start condition of the heating operation is satisfied. As shown in FIG. 6, at S11, controller 9 determines whether the specific condition, indicating that the first heat exchange capability is higher than the second heat exchange capability, is satisfied. When the specific condition is satisfied (YES at S11), controller 9 starts supplying refrigerant from compressor 1 to first solenoid valve 6 at S12, and then, opens first solenoid valve 6 and second solenoid valve 7 and returns the process to the main routine. When the specific condition is not satisfied (NO at S11), controller 9 opens first solenoid valve 6 and second solenoid valve 7 at S13, and then, starts supplying refrigerant from compressor 1 to first solenoid valve 6 and returns the process to the main routine.

When the specific condition is satisfied, supply of refrigerant from compressor 1 to first solenoid valve 6 is started with first solenoid valve 6 closed, so that the refrigerant of second heat exchanger 4 moves to between compressor 1 and first solenoid valve 6. First solenoid valve 6 and second solenoid valve 7 are then opened, so that the heating operation can be started with a larger amount of refrigerant distributed through first heat exchanger 2 than through second heat exchanger 4.

When the specific condition is not satisfied, first solenoid valve 6 and second solenoid valve 7 are opened before supply of refrigerant from compressor 1 to first solenoid valve 6 is started, so that the refrigerant of first heat exchanger 2 moves to second heat exchanger 4. Supply of refrigerant from compressor 1 to first solenoid valve 6 is then started, so that the heating operation can be started with a larger amount of refrigerant distributed through second heat exchanger 4 than through first heat exchanger 2.

Figure 7:
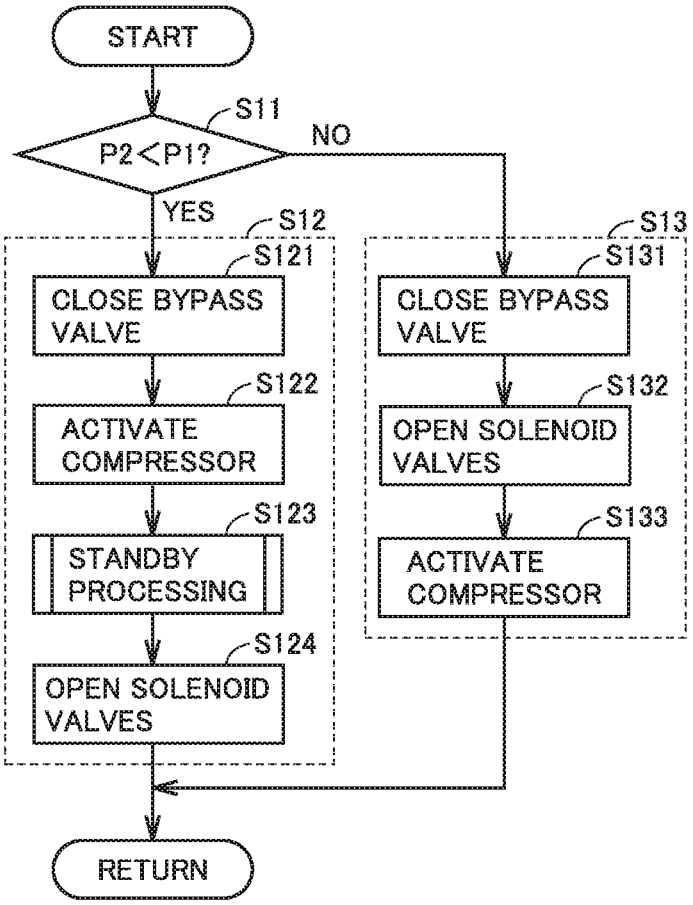
FIG. 7 is a flowchart specifically showing a flow of the process of FIG. 6 when the user has instructed to start the heating operation.

FIG. 7 is a flowchart specifically showing a flow of the process of FIG. 6 when the user has instructed to start the heating operation. The condition that the user has instructed to start the heating operation is included in the start condition of the heating operation. The instruction to start the heating operation by the user also includes an instruction to specify a start time. As shown in FIG. 7, at S11, controller 9 determines whether first pressure P1 is higher than second pressure P2. In the process shown in FIG. 7, the specific condition includes a condition that first pressure P1 is higher than second pressure P2.

When first pressure P1 is higher than second pressure P2 (YES at S11), controller 9 advances the process to S12. S12 includes S121 to S124. Controller 9 closes bypass valve 8 at S121 and advances the process to S122. Controller 9 activates compressor 1 at S122 to start supplying refrigerant from compressor 1 to first solenoid valve 6 and advances the process to S123. Controller 9 performs standby processing at S123, and then advances the process to S124. Controller 9 opens first solenoid valve 6 and second solenoid valve 7 at S124 and returns the process to the main routine.

When first pressure P1 is lower than or equal to second pressure P2 (NO at S11), controller 9 advances the process to S13. S13 includes S131 to S133. Controller 9 closes bypass valve 8 at S131 and advances the process to S132. Controller 9 opens first solenoid valve 6 and second solenoid valve 7 at S132 and advances the process to S133. Controller 9 activates compressor 1 at S133 to start supplying refrigerant from compressor 1 to first solenoid valve 6 and returns the process to the main routine.

Figure 8:
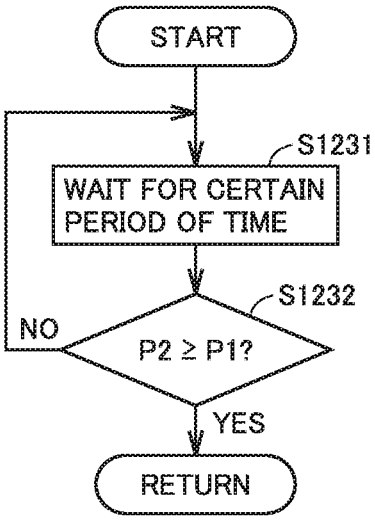
FIG. 8 is a flowchart showing a specific processing flow of standby processing of FIG. 7.

FIG. 8 is a flowchart showing a specific processing flow of standby processing S123 of FIG. 7. As shown in FIG. 8, controller 9 waits for a certain period of time at S1231, and then advances the process to S1232. At S1232, controller 9 determines whether second pressure P2 is higher than or equal to the first pressure P1. When second pressure P2 is lower than first pressure P1 (NO at S1232), controller 9 returns the process to S1231. When second pressure P2 is higher than or equal to first pressure P1 (YES at S1232), controller 9 returns the process to the main routine.

The start condition of the heating operation includes an end condition of the defrosting operation in refrigeration cycle apparatus 100. The end condition of the heating operation includes a start condition of the defrosting operation. Control performed when the defrosting operation ends and the heating operation is restarted will now be described with reference to FIGS. 9 to 11. The start condition of the defrosting operation includes, for example, a condition that second temperature T2 around second heat exchanger 4 placed outdoors is lower than or equal to a first reference temperature. The end condition of the defrosting operation includes, for example, a condition that second temperature T2 is higher than or equal to a second reference temperature.

Figure 9:
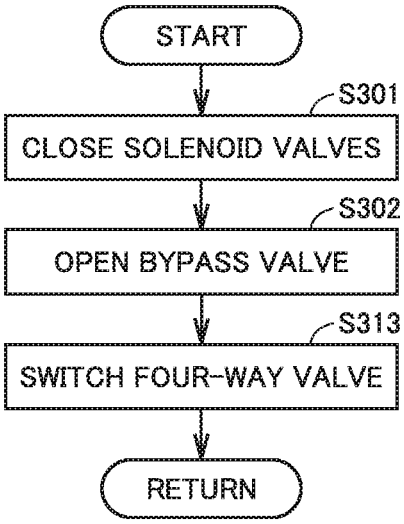
FIG. 9 is a flowchart showing a process performed by the controller of FIG. 1 when a start condition of a defrosting operation (a stop condition of the heating operation) is satisfied.

FIG. 9 is a flowchart showing a process performed by controller 9 when the start condition of the defrosting operation (the stop condition of the heating operation) is satisfied. The process shown in FIG. 9 is a process in which S303 of FIG. 2 is replaced by S313. At S313, controller 9 switches four-way valve 5 and returns the process to the main routine.

Figure 10:
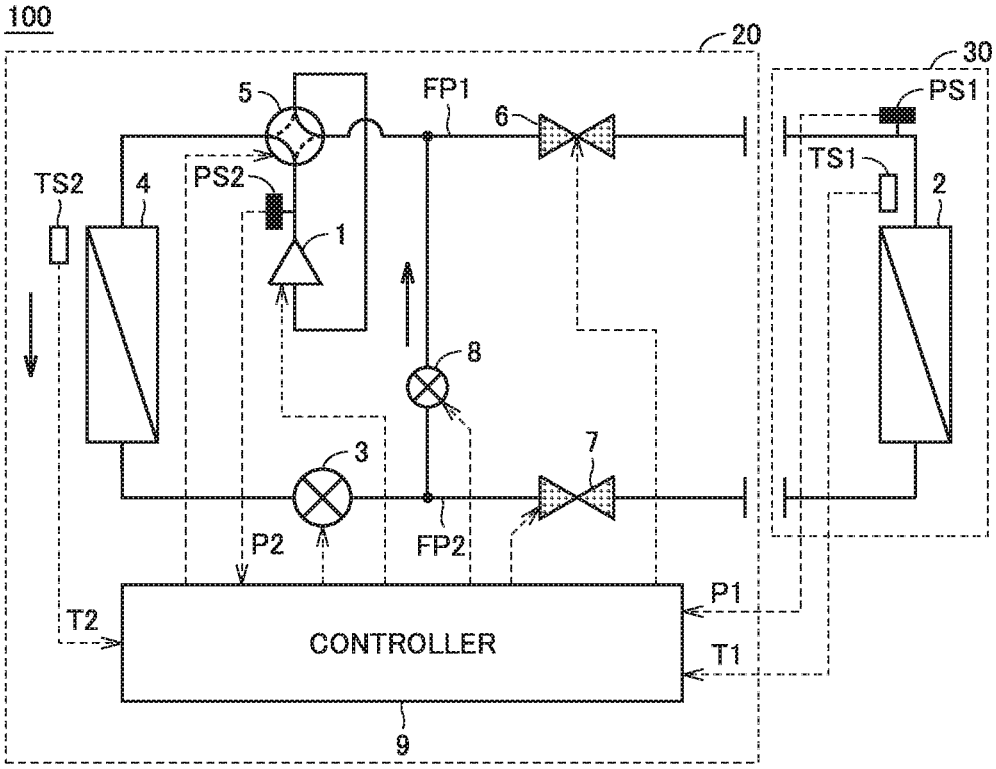
FIG. 10 is a functional block diagram showing a configuration of the refrigeration cycle apparatus when the defrosting operation is performed.

FIG. 10 is a functional block diagram showing a configuration of refrigeration cycle apparatus 100 when the defrosting operation is performed. As shown in FIG. 10, four-way valve 5 connects the discharge port of compressor 1 and second heat exchanger 4 to each other and also connects the inlet port of compressor 1 and first solenoid valve 6 to each other in the defrosting operation. Refrigerant circulates in order of compressor 1, second heat exchanger 4, expansion valve 3, and bypass valve 8.

Figure 11:
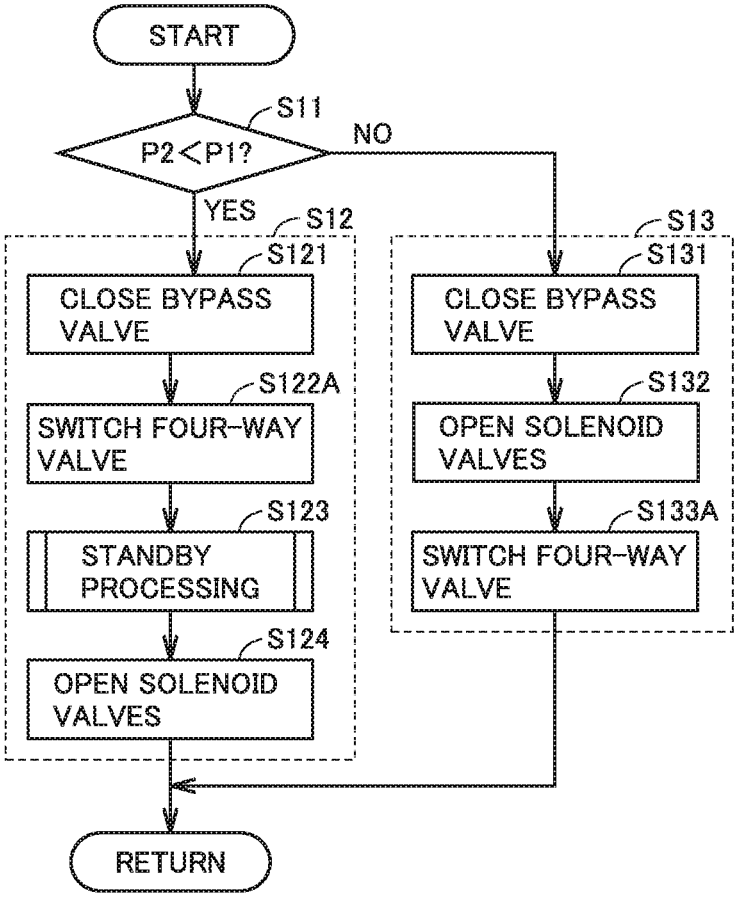
FIG. 11 is a flowchart specifically showing a flow of the process of FIG. 6 when an end condition of the defrosting operation (a start condition of the heating operation) is satisfied.

FIG. 11 is a flowchart specifically showing a flow of the process of FIG. 6 when the end condition of the defrosting operation (the start condition of the heating operation) is satisfied. In the process shown in FIG. 11, S122 and S133 of the process shown in FIG. 7 are replaced by S122A and S133A, respectively. The process is similar in the other steps, description of which will not be repeated. At S122A and S133A, controller 9 switches four-way valve 5 to connect the discharge port of compressor 1 and first solenoid valve 6 to each other and starts supplying refrigerant from compressor 1 to first solenoid valve 6.

Figure 12:
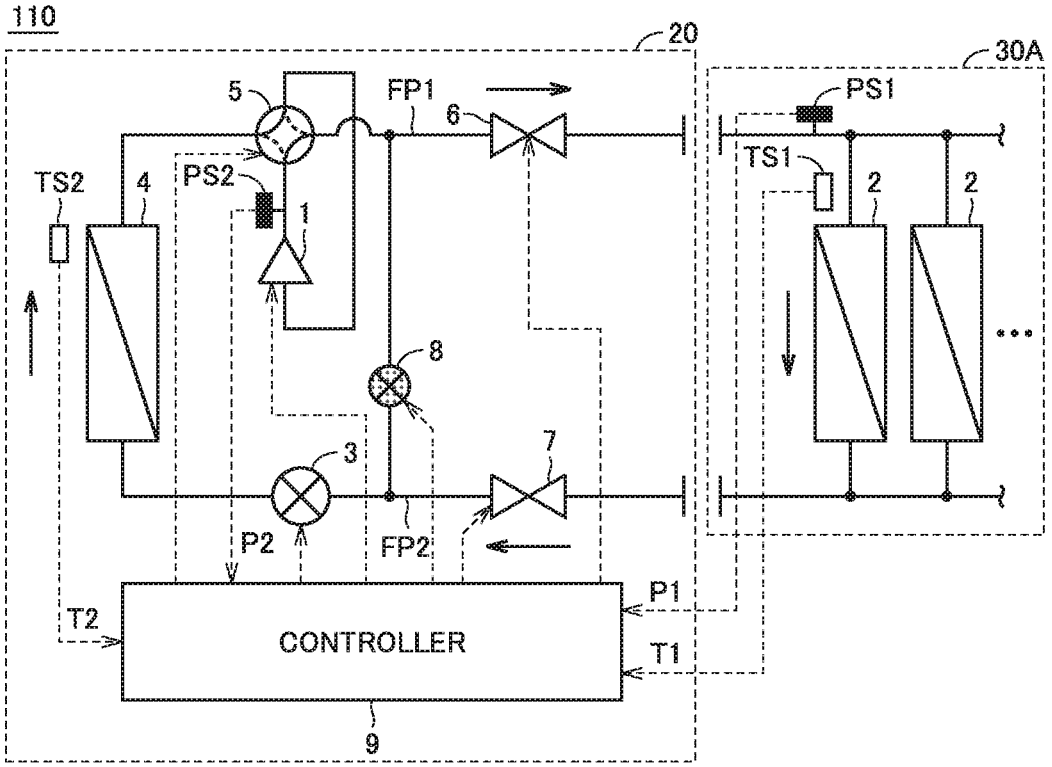
FIG. 12 shows a functional configuration of a refrigeration cycle apparatus according to a modification of Embodiment 1 and a flow of refrigerant in the heating operation.

Refrigeration cycle apparatus 100 includes one first heat exchanger 2 in indoor unit 30. In the refrigeration cycle apparatus according to the embodiment, an indoor unit 30A may include a plurality of first heat exchangers 2 as in a refrigeration cycle apparatus 110 shown in FIG. 12.

Although first solenoid valve 6 and second solenoid valve 7 may be of a unilateral type that can be closed when refrigerant flows from an IN port toward an OUT port, they are desirably of bilateral type that can be closed irrespective of the direction of flow of refrigerant. The use of the bilateral solenoid valves can trap refrigerant in first heat exchanger 2 within indoor unit 30 when the cooling operation is stopped also in the cooling operation in which the direction of flow of refrigerant is opposite to that in the heating operation, thus improving cooling capability when the cooling operation is started.

Figure 13:
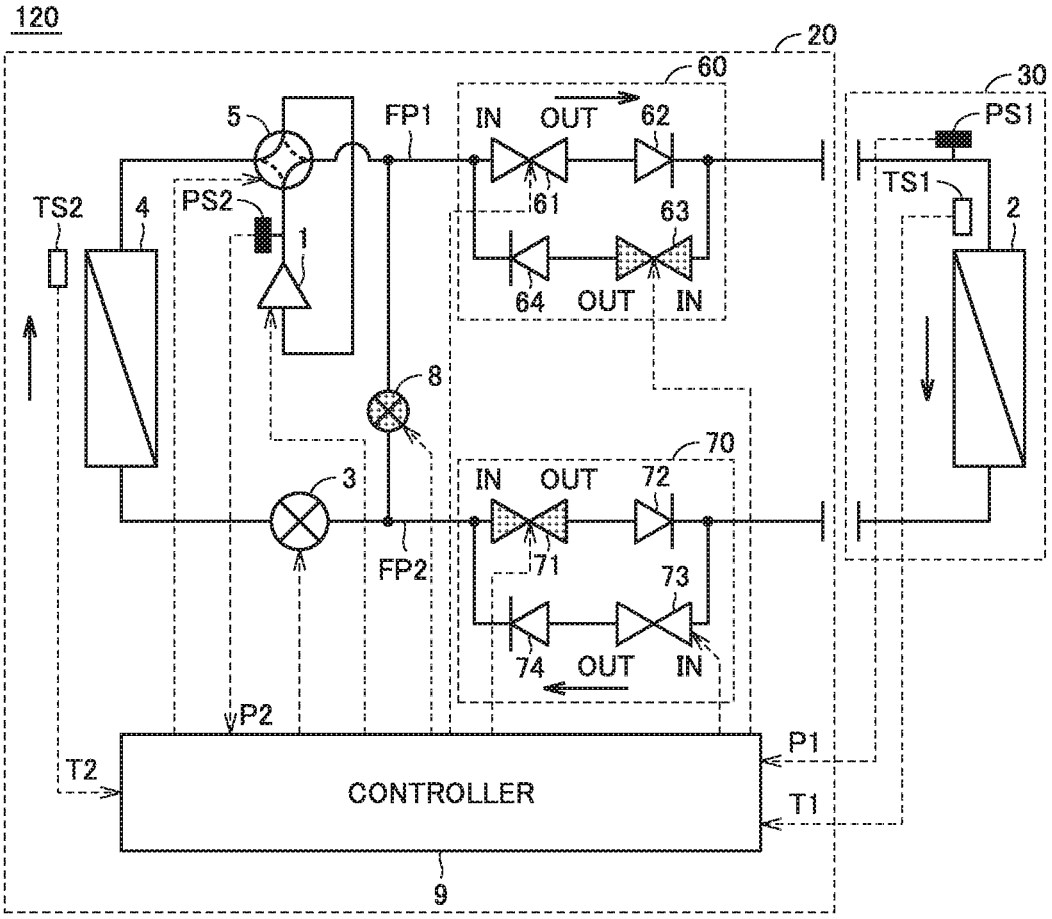
FIG. 13 shows a functional configuration of a refrigeration cycle apparatus according to another modification of Embodiment 1 and a flow of refrigerant in the heating operation.

The use of check valves and unilateral solenoid valves can achieve a function similar to that of the bilateral solenoid valves. FIG. 13 shows a functional configuration of a refrigeration cycle apparatus 120 according to another modification of Embodiment 1 and a flow of refrigerant in the heating operation. In the configuration of refrigeration cycle apparatus 120, first solenoid valve 6 and second solenoid valve 7 of refrigeration cycle apparatus 100 of FIG. 1 are replaced by a first valve circuit 60 and a second valve circuit 70, respectively. The other components are similar, description of which will not be repeated.

As shown in FIG. 13, first valve circuit 60 includes solenoid valves 61 and 63 of unilateral type and check valves 62 and 64. Solenoid valves 61 and 63 can be closed when refrigerant flows from the IN port to the OUT port of each solenoid valve. The IN port of solenoid valve 61 is connected to the discharge port of compressor 1 through four-way valve 5. The OUT port of solenoid valve 61 is connected to the inlet port of check valve 62. The IN port of solenoid valve 63 is connected to the outlet port of check valve 62. The OUT port of solenoid valve 63 is connected to the inlet port of check valve 64. The outlet port of check valve 64 is connected to the IN port of solenoid valve 61. The outlet port of check valve 62 is connected to second heat exchanger 4. In the heating operation, solenoid valve 61 is kept open, and solenoid valve 63 is kept closed.

Second valve circuit 70 includes solenoid valves 71 and 73 of unilateral type and check valves 72 and 74. Solenoid valves 71 and 73 can be closed when refrigerant flows from the IN port to the OUT port of each solenoid valve. The IN port of solenoid valve 71 is connected to expansion valve 3. The OUT port of solenoid valve 71 is connected to the inlet port of check valve 72. The IN port of solenoid valve 73 is connected to the outlet port of check valve 72. The OUT port of solenoid valve 73 is connected to the inlet port of check valve 74. The outlet port of check valve 74 is connected to the IN port of solenoid valve 71. The outlet port of check valve 72 is connected to first heat exchanger 2. In the heating operation, solenoid valve 71 is kept closed, and solenoid valve 73 is kept open.

Figure 14:
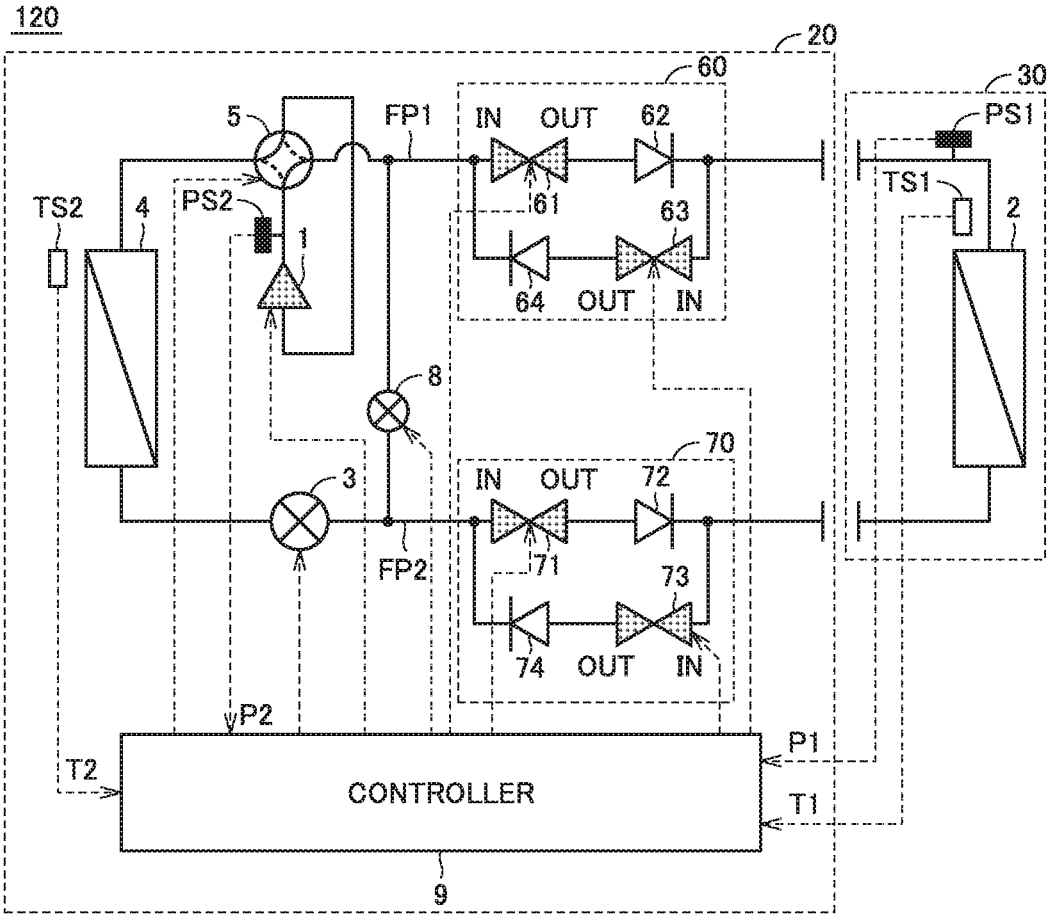
FIG. 14 shows a functional configuration when the heating operation is stopped in the refrigeration cycle apparatus of FIG. 13.

The refrigerant discharged from compressor 1 in the heating operation flows through solenoid valve 61 and check valve 62 into first heat exchanger 2. The refrigerant discharged from compressor 1 fails to flow through check valve 64. Also, since solenoid valve 63 is closed in the heating operation, the refrigerant from check valve 62 fails to flow through solenoid valve 63. The refrigerant from first heat exchanger 2 flows through solenoid valve 73 and check valve 74 into expansion valve 3. The refrigerant from first heat exchanger 2 fails to flow through check valve 72. Also, since solenoid valve 71 is closed in the heating operation, the refrigerant from check valve 74 fails to flow through solenoid valve 71. As shown in FIG. 14, solenoid valves 61 and 73 can be closed to trap refrigerant in first heat exchanger 2 when the heating operation is stopped.

Figure 15:
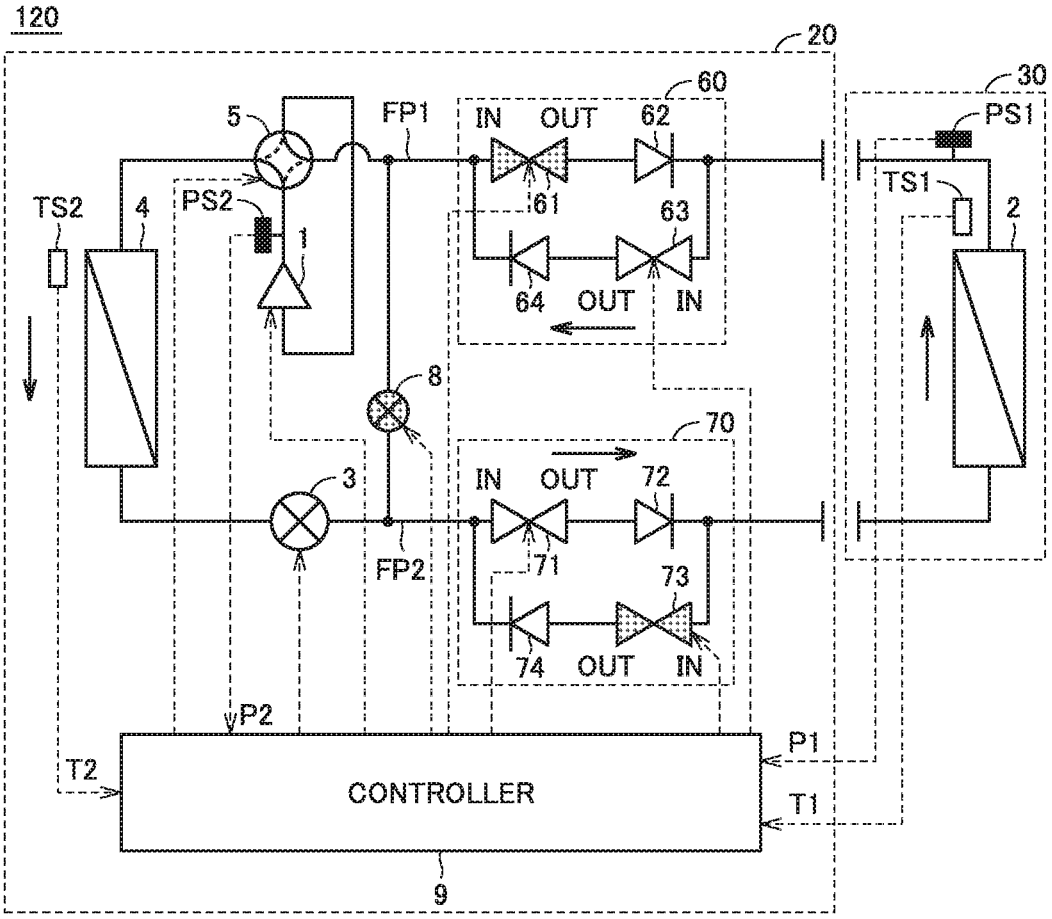
FIG. 15 shows a functional configuration of the refrigeration cycle apparatus of FIG. 13 and a flow of refrigerant in a cooling operation.

FIG. 15 shows a functional configuration of a refrigeration cycle apparatus 120 according to another modification of Embodiment 1 and a flow of refrigerant in the cooling operation. In the cooling operation, four-way valve 5 connects the discharge port of compressor 1 and second heat exchanger 4 to each other and also connects the inlet port of compressor 1 and the IN port of solenoid valve 61 to each other. Refrigerant circulates in order of compressor 1, second heat exchanger 4, expansion valve 3, and first heat exchanger 2.

Figure 16:
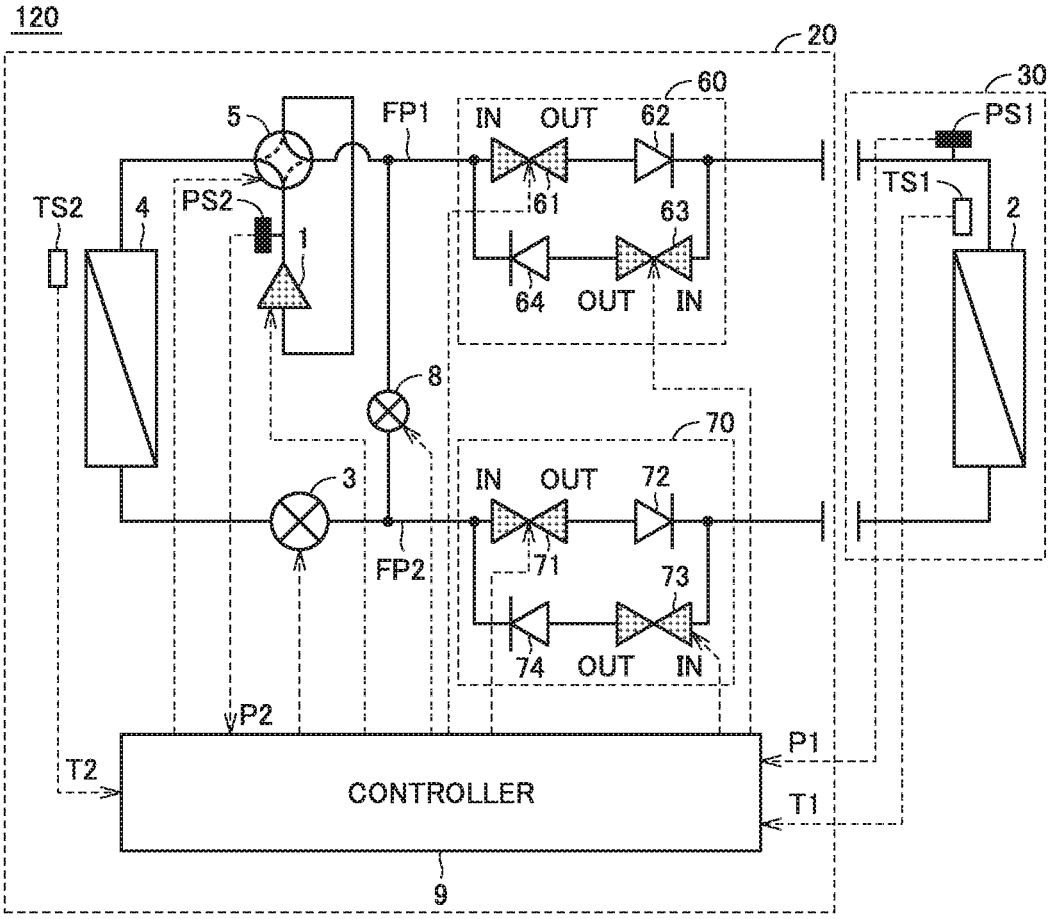
FIG. 16 shows a functional configuration when the cooling operation is stopped in the refrigeration cycle apparatus of FIG. 15.

In the cooling operation, the refrigerant from expansion valve 3 flows through solenoid valve 71 and check valve 72 into first heat exchanger 2. The refrigerant from expansion valve 3 fails to flow through check valve 74. Also, since solenoid valve 73 is closed in the cooling operation, the refrigerant from check valve 72 fails to flow through solenoid valve 73. The refrigerant from first heat exchanger 2 flows through solenoid valve 63 and check valve 64 to be sucked by compressor 1. The refrigerant from first heat exchanger 2 fails to flow through check valve 62. Also, since solenoid valve 61 is closed in the cooling operation, the refrigerant from check valve 64 fails to flow through solenoid valve 61. As shown in FIG. 16, solenoid valves 63 and 71 can be closed to trap refrigerant in first heat exchanger 2 when the cooling operation is stopped.

Bidirectional solenoid valves or valve circuits each functioning similarly to the bidirectional solenoid valves can trap refrigerant in first heat exchanger 2 also when the cooling operation is stopped, as when the heating operation is stopped. This can improve the cooling capacity in start of the cooling operation.

As described above, the refrigeration cycle apparatus according to Embodiment 1 can have improved heating capability in start of the heating operation.

Embodiment 2

Embodiment 1 has described the case in which the condition on a refrigerant pressure is used as the specific condition indicating that the first heat exchange capability is higher than the second heat exchange capability. Embodiment 2 will describe a case in which a condition on a refrigerant temperature is used as the specific condition. In Embodiment 2, FIGS. 1, 7, and 11 of Embodiment 1 are replaced by FIGS. 17, 18, and 20, respectively.

Figure 17:
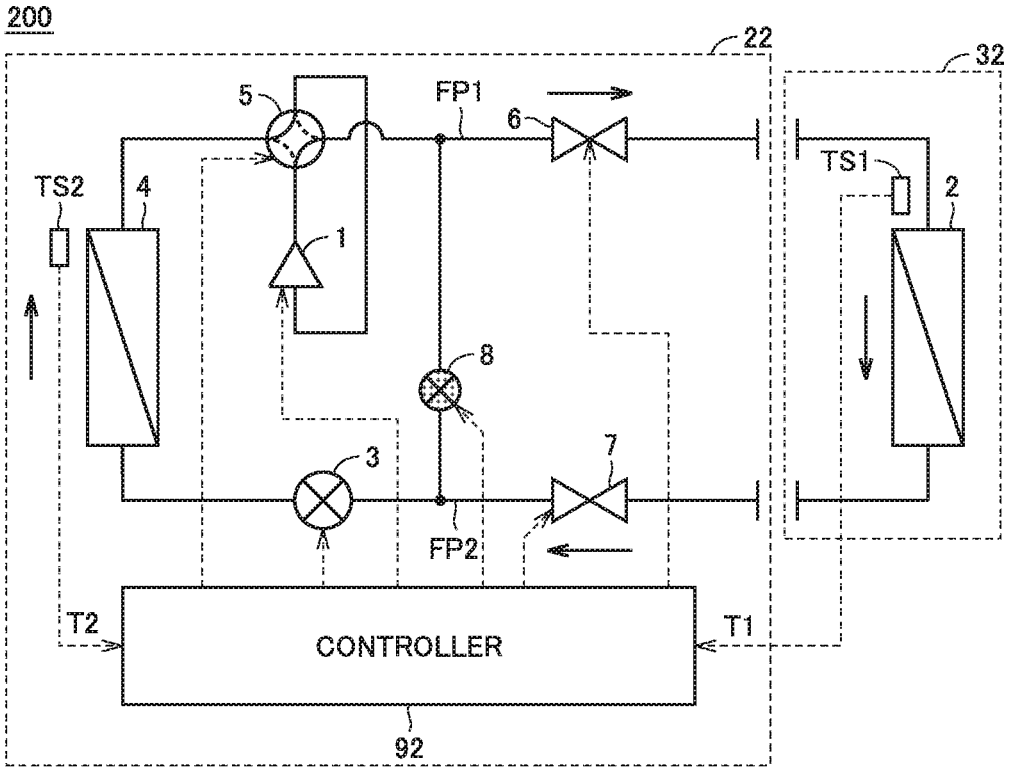
FIG. 17 is a functional block diagram showing a configuration of a refrigeration cycle apparatus according to Embodiment 2 and a flow of refrigerant in the heating operation.

FIG. 17 is a functional block diagram showing a configuration of a refrigeration cycle apparatus 200 according to Embodiment 2 and a flow of refrigerant in the heating operation. The configuration of refrigeration cycle apparatus 200 is obtained by removing pressure sensors PS1 and PS2 from the configuration of refrigeration cycle apparatus 100 of FIG. 1 and replacing controller 9 of FIG. 1 by a controller 92. The other components are similar, description of which will not be repeated.

Figure 18:
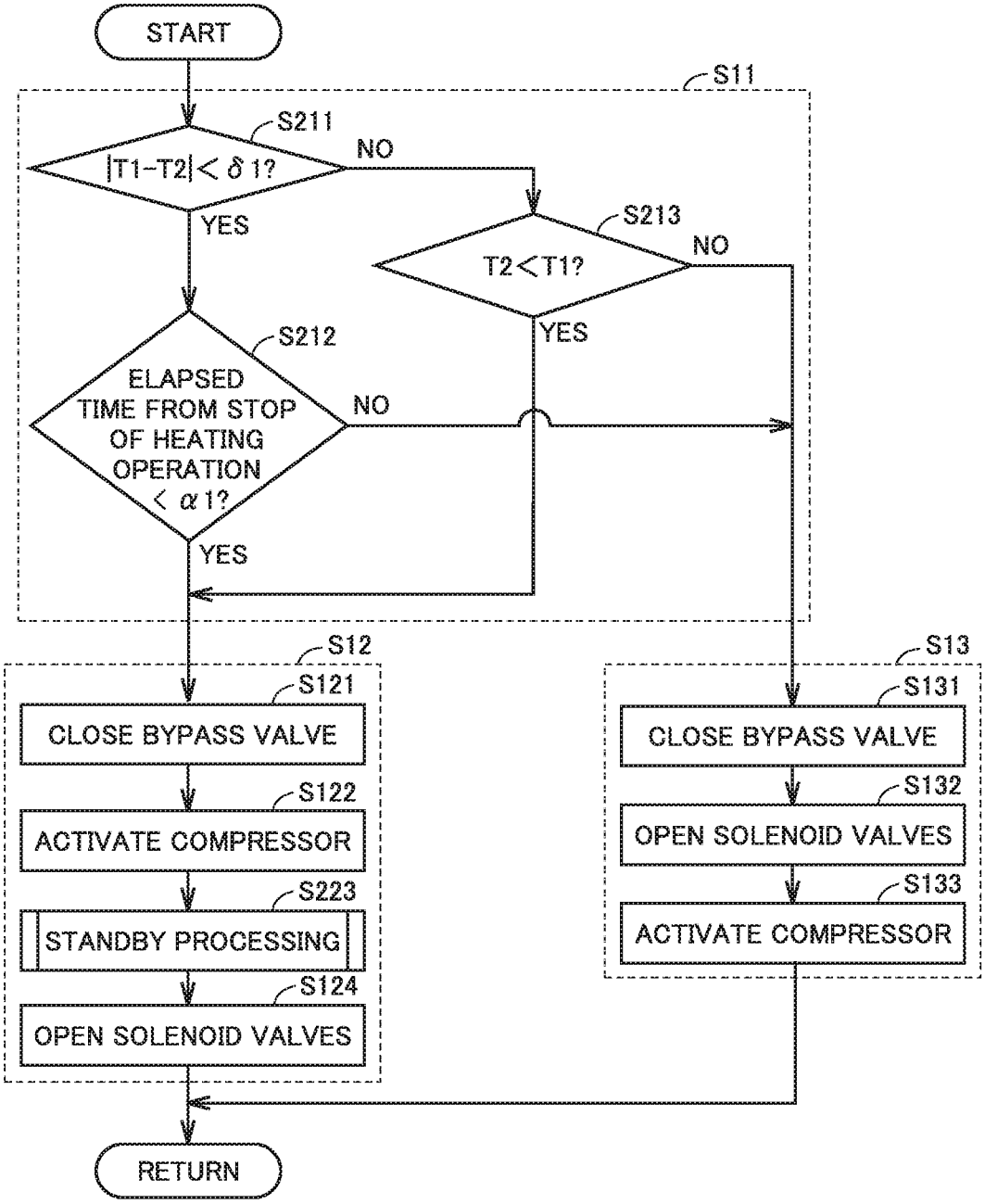
FIG. 18 is a flowchart specifically showing a flow of the process of FIG. 6 when the user has instructed to start the heating operation in Embodiment 2.

FIG. 18 is a flowchart specifically showing a flow of the process of FIG. 6 when the user has instructed to start the heating operation in Embodiment 2. At S12 of FIG. 18, S123 of FIG. 7 is replaced by S223. S13 of FIG. 18 is similar to S13 of FIG. 6. S11 and S223 of FIG. 18 will be described below.

As shown in FIG. 18, S11 includes S211 to S213. At S211, controller 92 determines whether an absolute value of a difference between first temperature T1 and second temperature T2 is smaller than a threshold δ1. When the absolute value is smaller than threshold δ1 (YES at S211), controller 92 determines that first temperature T1 and second temperature T2 are nearly equal to each other and advances the process to S212.

At S212, controller 92 determines whether an elapsed time from a stop of the heating operation is shorter than a reference period of time α1. When the elapsed time from a stop of heating is shorter than reference period of time α1 (YES at S212), controller 92 advances the process to S12. When an elapsed time from a stop of heating is longer than or equal to reference period of time α1 (NO at S212), controller 92 advances the process to S13. When first temperature T1 and second temperature T2 are nearly equal to each other, reference period of time α1 can be appropriately calculated by experiment in a real machine or by simulation based on an elapsed time from a stop of heating as an elapsed time in which the first heat exchange capability is lower than the second heat exchange capability.

When the absolute value of a difference between first temperature T1 and second temperature T2 is not less than threshold δ1 (NO at S211), controller 92 advances the process to S213. At S213, controller 92 determines whether first temperature T1 is higher than second temperature T2. When first temperature T1 is higher than second temperature T2 (YES at S213), controller 92 advances the process to S12. When first temperature T1 is lower than or equal to second temperature T2 (NO at S213), controller 92 advances the process to S13.

In the process shown in FIG. 18, the specific condition includes a condition that an absolute value of a difference between first temperature T1 and second temperature T2 is greater than threshold δ1 and first temperature T1 is higher than second temperature T2 and a condition that the absolute value is smaller than threshold δ1 and reference period of time α1 has not elapsed from a stop of the heating operation.

Figure 19:
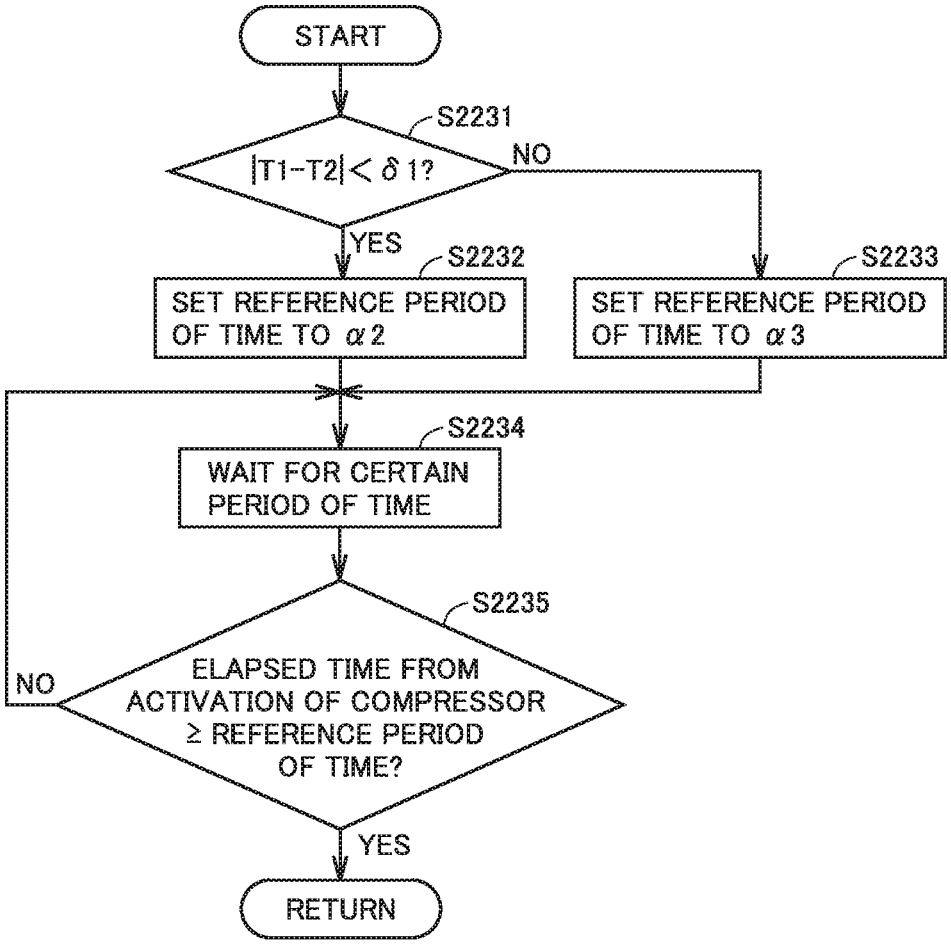
FIG. 19 is a flowchart showing a specific processing flow of standby processing of FIG. 18.

FIG. 19 is a flowchart showing a specific processing flow of standby processing (S223) of FIG. 18. As shown in FIG. 19, at S2231, controller 92 determines whether an absolute value of a difference between first temperature T1 and second temperature T2 is smaller than threshold δ1. When the absolute value is smaller than threshold δ1 (YES at S2231), at S2232, controller 92 sets the reference period of time to α2 and advances the process to S2234. When the absolute value is not less than threshold δ1 (NO at S2231), at S2233, controller 92 sets the reference period of time to α3 and advances the process to S2234.

Controller 92 waits for a certain period of time at S2234, and then advances the process to S2235. At S2235, controller 92 determines whether an elapsed time from activation of compressor 1 is longer than or equal to the reference period of time. When the elapsed time is longer than or equal to the reference period of time (YES at S2235), controller 92 returns the process to the main routine. When the elapsed time is shorter than the reference period of time (NO at S2235), controller 92 returns the process to S2234. Reference periods of time α2 and α3 can be appropriately calculated by experiment in a real machine or by simulation based on an elapsed time from activation of compressor 1 as an elapsed time in which the pressure of the refrigerant between compressor 1 and first solenoid valve 6 is higher than the pressure of the refrigerant between first solenoid valve 6 and first heat exchanger 2.

Figure 20:
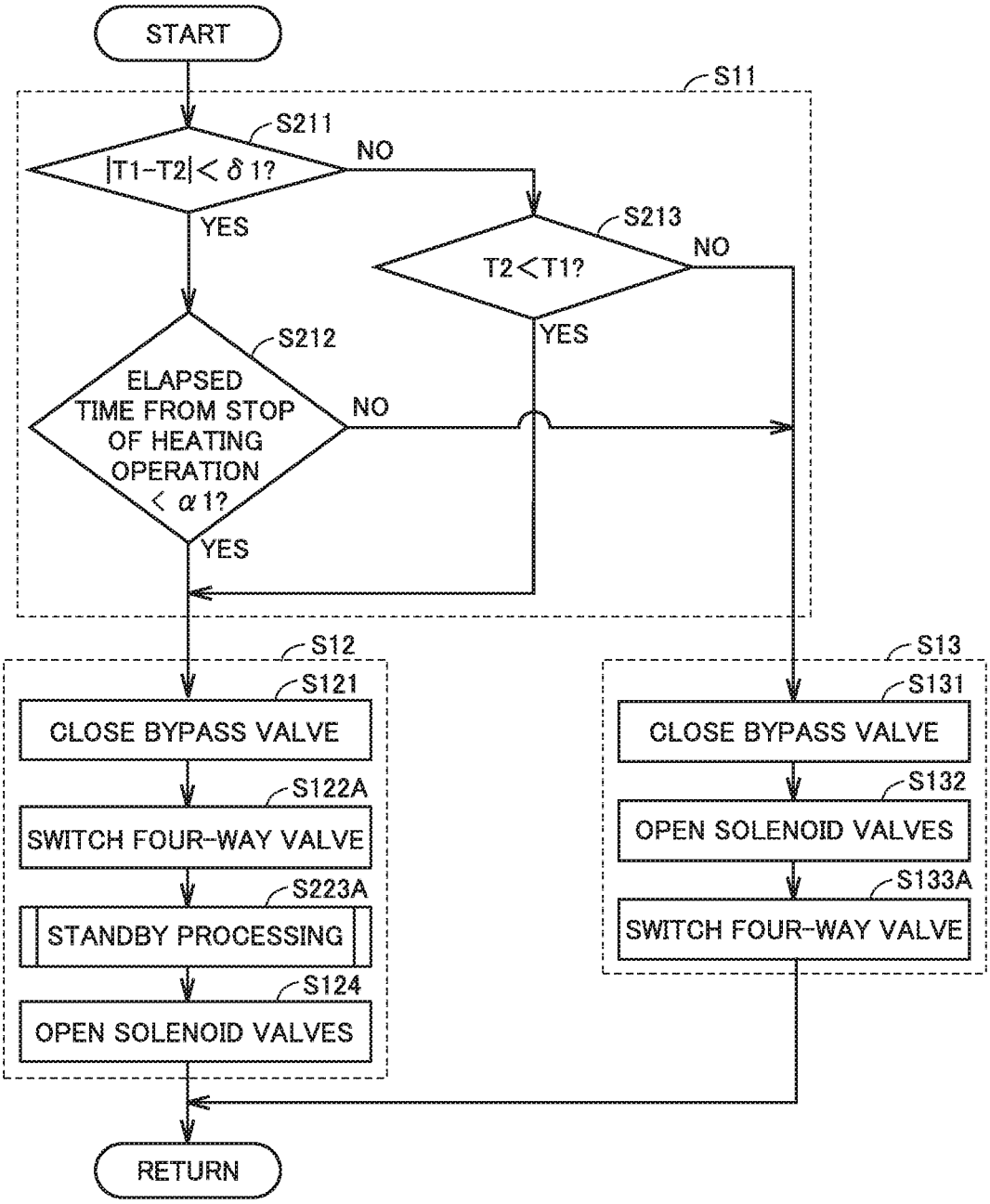
FIG. 20 is a flowchart specifically showing a flow of the process of FIG. 6 when the end condition of the defrosting operation (the start condition of the heating operation) is satisfied in Embodiment 2.

FIG. 20 is a flowchart specifically showing a flow of the process of FIG. 6 when the end condition of the defrosting operation (the start condition of the heating operation) is satisfied in Embodiment 2. In the process shown in FIG. 20, S122, S223, and S133 of the process shown in FIG. 18 are replaced by S122A, S223A, and S133A, respectively. The process is similar in the other steps to that of FIG. 18, description of which will not be repeated. Controller 92 switches four-way valve 5 at S122A and S133A to start supplying refrigerant from compressor 1 to first solenoid valve 6.

Figure 21:
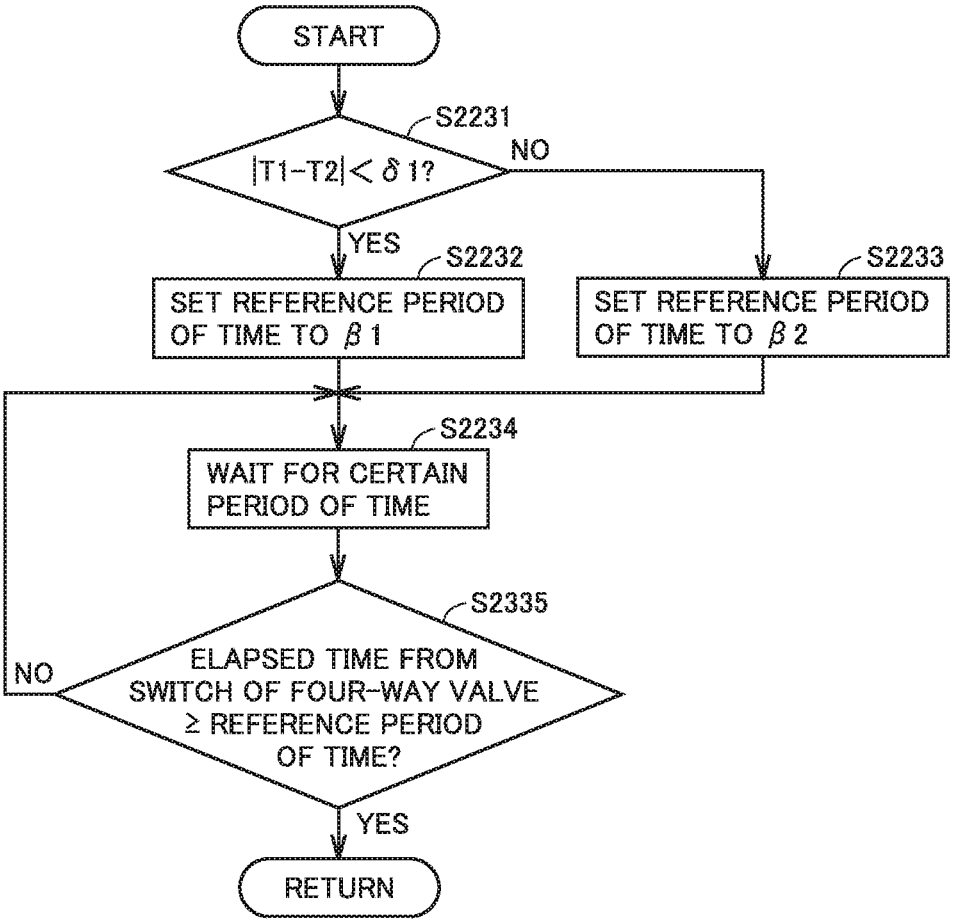
FIG. 21 is a flowchart showing a specific processing flow of standby processing of FIG. 20.

FIG. 21 is a flowchart showing a specific processing flow of standby processing (S223A) of FIG. 20. In the process shown in FIG. 21, reference period of time α2 at S2232 shown in FIG. 19 is replaced by β1, and reference period of time α3 at S2233 is replaced by β2. Also, S2235 of FIG. 19 is replaced by S2335. The process is similar in the other steps to that of FIG. 19, description of which will not be repeated.

As shown in FIG. 21, at S2335, controller 92 determines whether an elapsed time from a switch of four-way valve 5 is longer than or equal to a reference period of time. When the elapsed time is longer than or equal to the reference period of time (YES at S2335), controller 92 returns the process to the main routine. When the elapsed time is shorter than the reference period of time (NO at S2335), controller 92 returns the process to S2234. Reference periods of time β1 and β2 can be appropriately calculated by experiment in a real machine or by simulation based on an elapsed time from a switch of four-way valve 5 as an elapsed time in which the pressure of refrigerant between compressor 1 and first solenoid valve 6 is higher than the pressure of refrigerant between first solenoid valve 6 and first heat exchanger 2.

As described above, the refrigeration cycle apparatus according to Embodiment 2 can have improved heating capability in start of the heating operation. Also, the refrigeration cycle apparatus according to Embodiment 2 needs no pressure sensor, and accordingly, can be manufactured at lower cost.

The embodiments disclosed herein are also intended to be implemented in combination as appropriate within a range free of inconsistency or contradiction. It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 compressor, 2 first heat exchanger, 3 expansion valve, 4 second heat exchanger, 5 four-way valve, 6 first solenoid valve, 7 second solenoid valve, 8 bypass valve, 9, 92 controller, 20 outdoor unit, 30, 30A indoor unit, 60 first valve circuit, 61, 63, 71, 73 solenoid valve, 62, 64, 72, 74 check valve, 70 second valve circuit, 100, 110, 120, 200 refrigeration cycle apparatus, FP1 first flow path, FP2 second flow path, PS1, PS2 pressure sensor, TS1, TS2 temperature sensor.

The invention claimed is:

1. A refrigeration cycle apparatus in which refrigerant circulates in order of a compressor, a first heat exchanger, an expansion valve, and a second heat exchanger in a heating operation, the refrigeration cycle apparatus comprising:

a first valve connected between the compressor and the first heat exchanger;

a second valve connected between the first heat exchanger and the expansion valve; and a controller configured to close the first and second valves when a stop condition of the heating operation is satisfied, wherein when a start condition of the heating operation is satisfied, the controller is configured to when a specific condition is satisfied, start supplying the refrigerant from the compressor to the first valve and then open the first and second valves, the specific condition indicating that a first heat exchange capability of the first heat exchanger is higher than a second heat exchange capability of the second heat exchanger, and when the specific condition is not satisfied, open the first and second valves and then start supplying the refrigerant from the compressor to the first valve.

2. The refrigeration cycle apparatus according to claim 1, wherein the specific condition includes a condition that a first pressure of the refrigerant between the first valve and the first heat exchanger is higher than a second pressure of the refrigerant between the compressor and the first valve, and the controller is configured to, when the start condition of the heating operation and the specific condition are satisfied, open the first and second valves upon or after the second pressure reaching the first pressure.

3. The refrigeration cycle apparatus according to claim 1, wherein the first heat exchanger is placed in a first space, the second heat exchanger is placed in a second space, and the specific condition includes a condition that an absolute value of a difference between a first temperature of the first space and a second temperature of the second space is greater than a threshold, and the first temperature is higher than the second temperature, and a condition that the absolute value is smaller than the threshold, and a reference period of time has not elapsed from a stop of the heating operation.

4. The refrigeration cycle apparatus according to claim 1, wherein the start condition of the heating operation includes a condition that a user has instructed to start the heating operation, the stop condition of the heating operation includes a condition that the user has instructed to stop the heating operation, and the controller is configured to activate the compressor to start supplying the refrigerant from the compressor to the first valve.

5. The refrigeration cycle apparatus according to claim 1, wherein the refrigeration cycle apparatus is configured to switch and perform the heating operation, a cooling operation, and a defrosting operation, the refrigeration cycle apparatus further comprises a flow path switching valve, and a third valve connected between a first flow path between the flow path switching valve and the first valve and a second flow path between the second valve and the expansion valve, the flow path switching valve is configured to connect a discharge port of the compressor and the first valve to each other and connect an inlet port of the compressor and the second heat exchanger to each other in the heating operation, and connect the discharge port of the compressor and the second heat exchanger to each other and connect the inlet port of the compressor and the first valve to each other in the cooling operation and the defrosting operation, the controller is configured to keep the third valve closed in the heating operation and the cooling operation, keep the third valve open in the defrosting operation, and close the first and second valves when the stop condition of the cooling operation is satisfied, the start condition of the heating operation includes an end condition of the defrosting operation, the stop condition of the heating operation includes a start condition of the defrosting operation, and the controller is configured to switch the flow path switching valve to start supplying the refrigerant from the compressor to the first valve.

* * * * *